United States Patent [19]

Basiulis

[11] 4,413,671

[45] Nov. 8, 1983

[54] SWITCHABLE ON-OFF HEAT PIPE

[75] Inventor: Algerd Basiulis, Redondo Beach, Calif.

[73] Assignee: Hughes Aircraft Company, El Segundo, Calif.

[21] Appl. No.: 374,570

[22] Filed: May 3, 1982

[51] Int. Cl.[3] ..... F28D 15/00; F28F 13/00

[52] U.S. Cl. ..... 165/1; 165/32; 165/104.27

[58] Field of Search ..... 165/1, 32, 104.27

[56] References Cited

U.S. PATENT DOCUMENTS

| | | | |
|---|---|---|---|
| 3,525,386 | 8/1970 | Grover | 165/32 |
| 3,958,627 | 5/1976 | Edelstein | 165/32 |
| 4,033,406 | 7/1977 | Basiulis | 165/32 |

*Primary Examiner*—Albert W. Davis, Jr.

*Attorney, Agent, or Firm*—Lewis B. Sternfels; W. J. Bethurum; A. W. Karambelas

[57] ABSTRACT

A heat pipe (10) includes an evaporator (18) to which a heat generating device is coupled. A heat dissipating condenser 14 is coupled to the evaporator by a thermally insulating tube 46. A capillary is on the interior surfaces of the evaporator, the condenser and the thermally insulating tube. Both working fluid and inert gas are placed therein. Reservoirs (16) for receiving the inert gas are joined to the condenser. Both the condenser and the gas reservoirs are thermally secured to a heat sink (28); however there is a path of higher thermal conductivity between the reservoir and the heat sink than between the condenser and the heat sink.

13 Claims, 6 Drawing Figures

SWITCHABLE ON-OFF HEAT PIPE

BACKGROUND OF THE INVENTION

1. Field of the Invention

The present invention relates to heat pipes and, in particular, to such heat pipes which are switchable from a condition where no heat is transferred to that where full heat transfer at a predetermined temperature occurs.

2. Description of the Prior Art

It is sometimes desired and at times required to have a sharp demarcation between full and no transfer of heat to a heat sink at a specific operating temperature. For example, certain electronic components, such as diodes and gun devices, operate best at a constant temperature. At lower temperatures their output is less than optimal, and at higher temperatures they may be damaged. To prevent such overheating, they are generally coupled to a heat sink; however the thermal connection slows their heating and therefore increases the time in which they become fully operative. It is therefore desirable that such electronic components be insulated from their heat sink to permit the fastest possible warm up and, as soon as they reach their operating temperature, a thermal coupling is made to maintain them at a constant operating temperature.

Known devices for controlling temperature are described in U.S. Pat. Nos. 3,563,309 and 3,651,865. These heat pipes operate on the variable conductance heat pipe (VCHP) principle. Inert gas as well as working fluid are sealed within the heat pipe for temperature control. There is heat transfer at all times to a greater or lesser extent. Therefore, there is no demarcation point between thermal insulation and thermal conductivity, in accordance with the above desire or requirement.

SUMMARY OF THE INVENTION

The present invention comprises a device which meets such ends by utilizing structure which acts as a thermal insulation between the source of heat and a heat sink below a predetermined temperature, and permits heat transfer within the structure above the predetermined temperature.

Specifically, a coupling between the source of heat and the heat sink comprises thermally insulating material, so that there will be poor conduction of heat. Both working fluid and an inert gas are receivable within the coupling. The inert gas prevents heat transfer and displaces any working fluid vapor from the coupling at temperatures below the predetermined temperature where the vapor partial pressure is less than the partial pressure of the gas. When the source of heat reaches the predetermined temperature, sufficient working fluid vapor exists so that its partial pressure is at least equal to that of the non-condensable inert gas and therefore is sufficiently high to displace the inert gas and to permit the coupling then to act as a heat pipe. To ensure that the inert gas is properly displaced from the coupling, it is received in a reservoir which is maintained cooler than that portion of the heat pipe which acts as a condenser.

Among the several advantages flowing therefrom, primarily, such a heat pipe operates as an "off-on" switch so that no heat transfer occurs at lower temperatures and, with a clearly definable switch-on, heat transfer occurs at an operating temperature. Other aims and advantages as well as a more complete understanding of the present invention will appear from the following explanation of an exemplary embodiment and the accompanying drawings thereof.

DETAILED DESCRIPTION OF THE INVENTION

Figure 1:
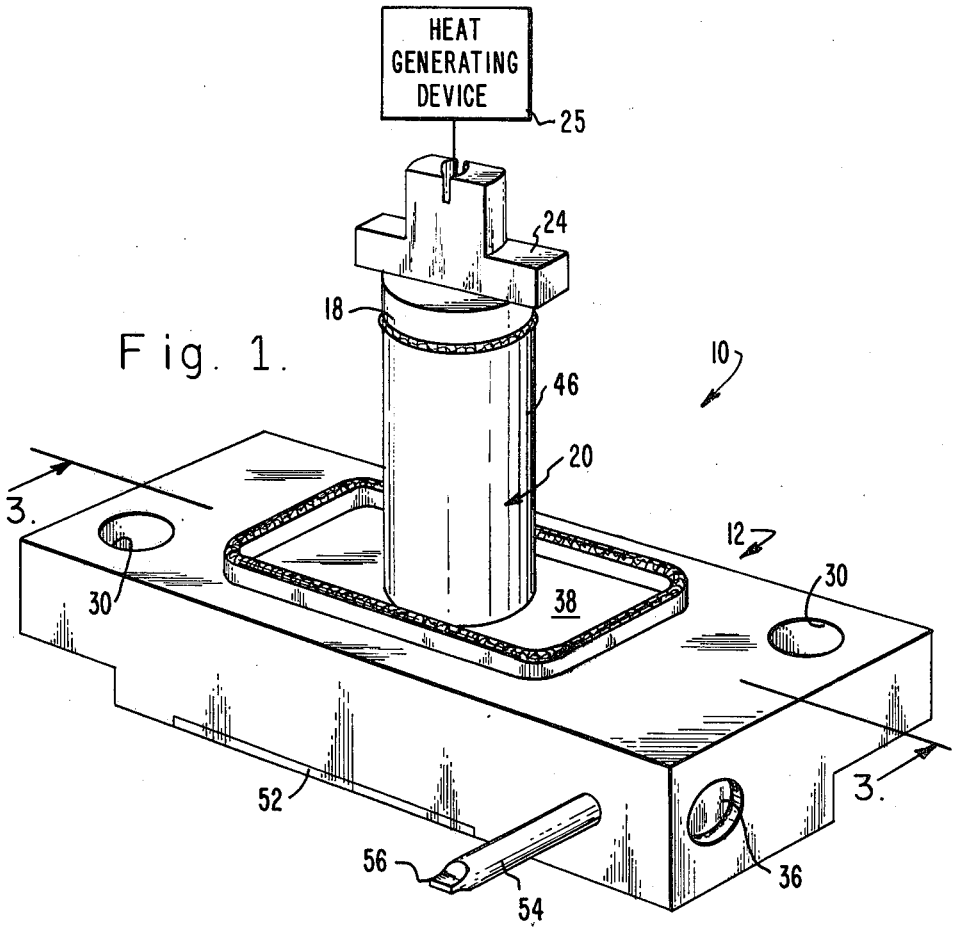
FIG. 1 is a perspective view of the present invention.
Figure 2:
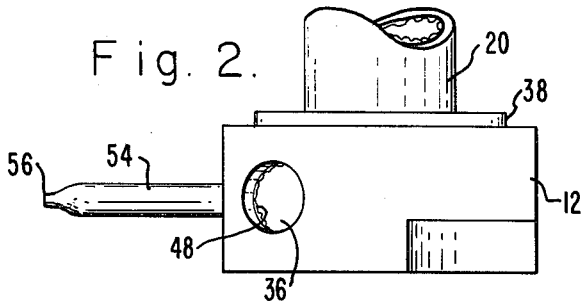
FIG. 2 is a side view thereof.
Figure 3:
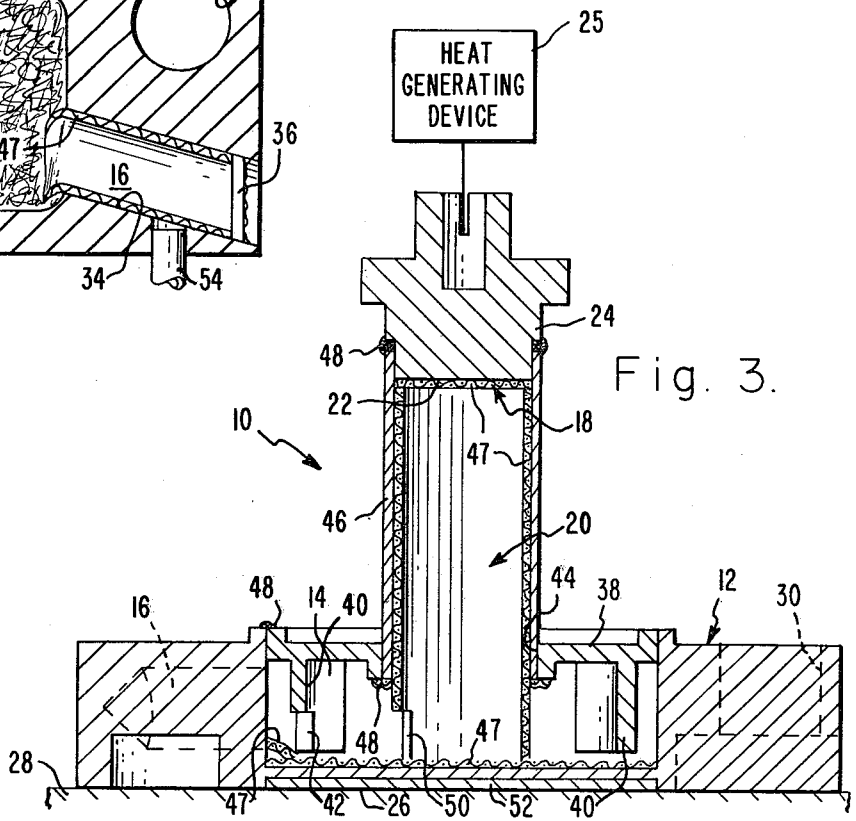
FIG. 3 is a cross-sectional view taken along lines 3—3 of FIG. 1, and attached to a heat sink.

As shown in FIGS. 1–5, a switchable off-on heat pipe 10 comprises a base portion 12, including a condenser section 14 and a gas reservoir 16, an evaporator section 18, and a section 20 which couples the evaporator and condenser sections. Evaporator section 18 is formed on a surface 22 on a cap 24 on which a heat generating device 25 is mounted. Base 12 is coupled at least at its bottom surface 26 to a heat sink, which is generally identified by indicium 28 in FIG. 3. Such coupling may be made in any appropriate manner, such as by bolts extending through holes 30 in the base portion.

Figure 4:
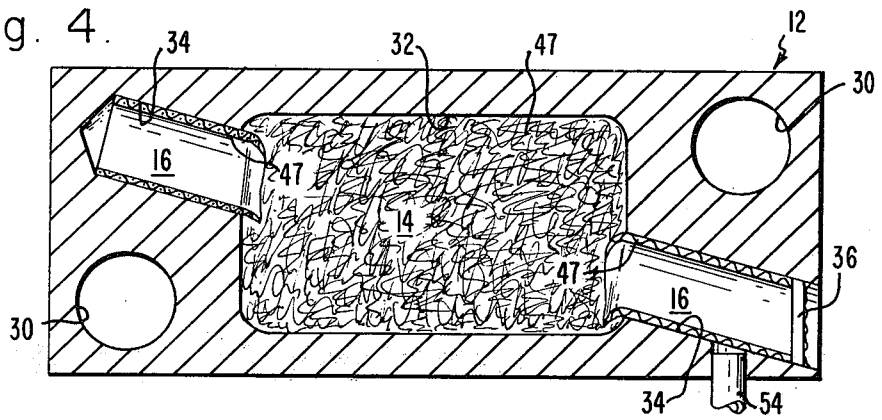
FIG. 4 is a cross-sectional view of the condenser and gas reservoir in the base portion.
Figure 5:
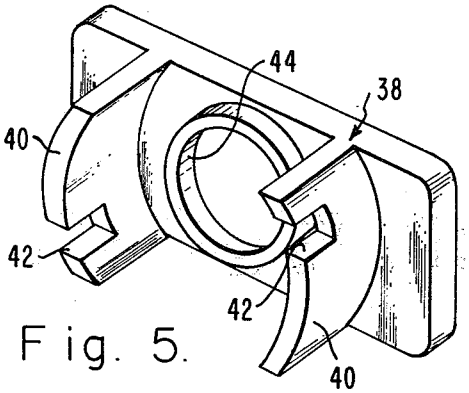
FIG. 5 is a perspective view of a lid which is fittable within the base portion.

In base portion 12 are cavities 32 and 34. As shown in FIG. 4, cavity 32 is open while cavity pair 34 comprises a hole which is drilled through cavity 32. At its opening through the outside of the base portion, cavity 34 is sealed by a plug 36. It is to be understood that the particular manner of forming reservoir cavities 34 and any other parts of heat pipe 10 is given by way of example, and is simply one easy method of manufacture. Open cavity 32 is partially covered by a lid 38 which is provided with a pair of downwardly extending walls 40. Walls 40 are provided with slots 42 so that the walls act as separators between the gas reservoirs and the condenser section. However, slots 42 permit movement of gas and working fluid vapor therebetween.

Lid 38 is provided with an opening 44 into which a tubular stem 46 is inserted. Stem 46 acts as the section for physically coupling evaporator section 18 and condenser section 14.

A capillary comprising wick material 47 is positioned on all interior surfaces of cap 24, tube or stem 46, reservoir 16 and condenser section 14. While not imperative, it is preferred that the wick material extend into reservoir 16 in the event that any working fluid should have condensed or otherwise been placed therein. All parts are welded or otherwise secured together as shown, for example, by weld material 48.

While stem 46 is shown to extend only into lid 38 and secured to hole 44, the wick material in the stem extends completely through condenser section 14 and into contact with the wick material at its bottom. Slots 50 exist within the wick material of stem 46 to permit unimpeded flow of working fluid vapor and inert gas therethrough.

A working fluid and a non-condensable inert gas are placed within an evacuated heat pipe 10 through a supply tube 54 which is pinched off at 56. The quantities or amounts of working fluid and inert gas are determined based upon the following conditions. First, when the heat pipe is fully turned on, the partial pressure of the working fluid vapor is equal or greater than the partial pressure of the inert gas. Second, the inert gas is fully displaced into its reservoir.

There are critical conditions for proper operation of heat pipe 10. First, stem or tube 46 must be formed of a thermally insulating material. Second, the thermal couplings between heat sink 28 respectively to condenser section 14 and gas reservoir 16 are such as to provide a path of higher thermal conductivity between the gas reservoir and the heat sink than between the condenser section and the heat sink. The first criterion ensures that there is poor heat transfer between cap 24 and heat sink 28 in the absence of working fluid vapor. This condition is ensured by forming tube 46 of thermally insulating material. The second criterion may be effected, for example, by forming base 12 of copper and adding a stainless steel plate 52 to the bottom side of condenser section 14. As a consequence, gas reservoir 16 will be maintained cooler than condenser section 14 to ensure that gas will be properly collected and retained within the reservoirs at the time that heat pipe 10 is at its operating temperature. As a result, there is a sharp separation of inert gas and working fluid as soon as the heat pipe is in operation. It is to be understood, of course, that base portion 12 may be formed of stainless steel. Under these circumstances, plate 52 would not be used; instead, copper plates or conductive material would be secured between gas reservoirs 16 and the heat sink.

For a particular experiment using heat pipe 10, predetermined amounts of methanol, as the working fluid, and argon, as the non-condensable inert gas, were sealed within the otherwise evacuated heat pipe through use of supply tube 54 which was thereafter pinched off and sealed as shown at indicium 56. A copper mass, wrapped with resistance wire and fastened to cap 24, acted as a heat generating source in place of device 25, with a 10 watt input. During start-up at −54° C., the inert gas occupied the vapor space at least within section 20 and blocked heat transport by vapor flow of the working fluid. Since heat can be transferred only through tube 46 and because it is formed from an insulating material, not more than negligible heat is transfered. As a result, the copper mass acting as the heat generating device at cap 24 reached its operating temperature of 50° C. under three minutes. At this temperature, the partial pressure of the working fluid vapor substantially equalled the partial pressure of the inert gas. As the working fluid vapor pressure increased, the noncondensable gas was displaced into gas reservoirs 16. Working fluid vapor then flowed from evaporator section 18 to condenser section 14 and the condensed working fluid liquid returned by center core wick 47 within tube 46 back to the evaporator, so that heat transfer took place by conventional heat pipe action. The temperature of the heat generating device remained under 112° C.

Figure 6:
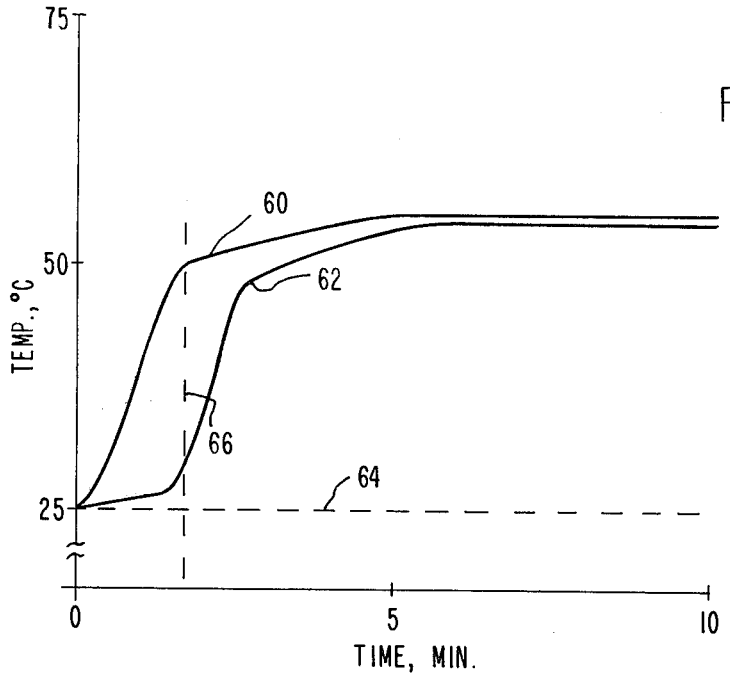
FIG. 6 is a graph depicting the "off-on" operation of a particular model of the present invention in terms of temperature versus time, for a constant electric power input at the heat pipe evaporator.

FIG. 6 graphically depicts the "off-on" switching action of a typical heat pipe embodied in the present invention. Curve 60 illustrates the temperature measured at evaporator section 18 while curve 62 depicts the temperature at condensor section 14. The heat sink temperature is designated by broken line 64. Switching occurs approximately at the time denoted by broken line 66. As is clear from the temperature curves, there is a relatively rapid rise in temperature from start-up at time 0 minutes to time 2.5 minutes (approximately) when the heat pipe begins to transfer heat from the evaporator and device 25 to heat sink 28. Thereafter, the temperature of the device levels off, shown in the example at 50° C. Thus, the on-switching occurs at a well-defined demarcation point. It is to be understood, of course, that the particular time to start-up and temperatures are merely illustrative and will change depending upon the operating conditions, materials used, particular construction, environment, device to be temperature regulated, etc.

Although the invention has been described with reference to a particular embodiment thereof, it should be realized that various changes and modifications may be made therein without departing from the spirit and scope of the invention.

What is claimed is:

1. A switchable heat pipe for enabling a heat generating device to warm rapidly to, and be maintained at, a predetermined operating temperature range comprising:

an evaporator section to which said device is coupled for receiving the heat generated thereby;

a heat dissipating condenser section;

a thermally insulating section joining said evaporator and condenser sections;

a capillary structure in and joining said sections;

measured amounts of working fluid and inert gas in said sections;

a reservoir for receiving said inert gas and communicating with said condenser section; and means coupling said condenser section and said reservoir to a heat sink, and defining a path of higher thermal conductivity between said reservoir and said heat sink than between said condenser section and said heat sink;

the amounts of said working fluid and said inert gas being selected so that, at temperatures below the predetermined operating temperature range, said working fluid as a vapor has a partial pressure which is less than that of said inert gas for enabling said inert gas to occupy said thermally insulating section, to prevent heat pipe operation and to enable said device to be thermally insulated from said heat sink and, at temperatures within the predetermined operating temperature range, the partial pressure of said working fluid vapor increases to cause displacement of said inert gas from said thermally insulating section into said gas reservoir and thereby to permit heat pipe conduction of the heat from said device to said heat sink.

2. A switchable heat pipe according to claim 1 in which said evaporator section includes means for supporting said heat generating device.

3. A switchable heat pipe according to claim 1 in which said heat generating device comprises an electronic component.

4. A switchable heat pipe according to claim 1 in which said coupling means comprise a first thermally conductive material joining said reservoir to said heat sink, and a second relatively less thermally conductive material joining said condenser section to said heat sink, to ensure that said reservoir remains cooler than said condenser section.

5. A switchable heat pipe according to claim 4 in which said first thermally conductive material comprises copper, and said thermally insulating section and said second relatively less thermally conductive material both comprise stainless steel.

6. A switchable heat pipe according to claim 4 in which said condenser section and said reservoir comprise means defining cavities in a single enclosure.

7. A switchable heat pipe according to claim 6 wherein said thermally insulating section comprises a tube extending from said condenser section to said evaporator section.

8. A switchable heat pipe according to claim 7 in which said evaporator section comprises a cap to which said device is mounted.

9. A switchable heat pipe accordingly to claim 8 wherein said enclosure comprises a base, in which said cavity means are formed and in which said condenser section cavity means opens from said base, and a lid at least partially covering said condenser section cavity means, said tube being joined to said lid.

10. A switchable heat pipe according to claim 9 in which said capillary structure comprises wick material secured to and covering all interior surfaces of said cap, said tube, said reservoir and said condenser section cavity means, a portion of said wick material freely extending from said tube and through said condenser section cavity means into another portion of said wick material therein.

11. A switchable heat pipe according to claim 10 in which said freely extending wick material portion is notched to provide an opening for unobstructed flow of said working fluid vapor and said inert gas therethrough.

12. In a heat pipe having a condenser coupled to a heat sink, an evaporator coupled to a source of heat, an inert gas reservoir, and a section coupling said condenser and said evaporator into a closed system, with working fluid and an inert gas therein, the improvement is respectively preventing and permitting transfer of the heat to said heat sink below and above a predetermined temperature, in which said coupling section comprises thermally insulating material, and which includes means for maintaining the inert gas reservoir cooler than said condenser.

13. A method for respectively preventing and allowing heat transfer between a source of heat and a heat sink below and above a predetermined temperature in a heat pipe having an evaporator at the heat source, a condenser at the heat sink and a working fluid and an inert gas sealed in the heat pipe, comprising the steps of thermally insulating the heat source from the heat sink, providing a reservoir for the inert gas and maintaining the reservoir at a temperature less than that of the condenser.

* * * * *